US006640742B1

(12) United States Patent
Grupp

(10) Patent No.: US 6,640,742 B1
(45) Date of Patent: Nov. 4, 2003

(54) DEVICE FOR PRODUCING SIGNAL TONES BY MEANS OF CHIMES SUSPENDED FROM A SHARED OSCILLATING CARRIER PLATE

(76) Inventor: David Grupp, Frühlingshalde 7, 70191 Stuttgart (DE)

( * ) Notice: Subject to any disclaimer, the term of this patent is extended or adjusted under 35 U.S.C. 154(b) by 0 days.

(21) Appl. No.: 10/129,918

(22) PCT Filed: Nov. 14, 2000

(86) PCT No.: PCT/DE00/03969

§ 371 (c)(1),
(2), (4) Date: May 10, 2002

(87) PCT Pub. No.: WO01/37253

PCT Pub. Date: May 25, 2001

(30) Foreign Application Priority Data

Nov. 17, 1999 (DE) ..... 199 55 343

(51) Int. Cl.[7] ..... G08B 3/00

(52) U.S. Cl. ..... 116/169; 84/402; 84/404; 446/418

(58) Field of Search ..... 116/169, 141, 116/150, 154, 151, 148, 25, 22 A; D10/116; 446/265, 422, 242, 418 XF, 408; 84/402 XF, 403, 404, 405

(56) References Cited

U.S. PATENT DOCUMENTS

| | | | | | |
|---|---|---|---|---|---|
| 1,664,871 | A | | 4/1928 | Werder | |
| 5,208,578 | A | * | 5/1993 | Tury et al. | 340/392.2 |
| 5,369,391 | A | | 11/1994 | Gadsby | |
| 5,402,700 | A | * | 4/1995 | Cohen | 84/404 |
| 5,648,624 | A | * | 7/1997 | Smith | 84/404 |
| 5,831,516 | A | * | 11/1998 | Jennings | 84/404 |
| 5,980,056 | A | * | 11/1999 | West | 362/86 |

FOREIGN PATENT DOCUMENTS

| | | |
|---|---|---|
| CH | 171 891 | 9/1934 |
| DE | 197 31 582 | 1/1999 |
| FR | 2 769 116 | 4/1999 |

* cited by examiner

*Primary Examiner*—Christopher W. Fulton
*Assistant Examiner*—Tania C. Courson
(74) *Attorney, Agent, or Firm*—Collard & Roe, P.C.

(57) ABSTRACT

The invention relates to known signal appliances comprising chime tubes which are fixed in a circle and chime by means of a centrally mounted, motor-driven striking element. The aim of the invention is to use a novel arrangement that omits striking elements, whereby space is saved, and uses chime tubes of essentially different diameters for producing very big differences in tone levels, whereby said chimes have constant lengths. Five chimes are suspended from a carrier plate. The carrier plate is swivelled around a predetermined area by means of the drive motor and a pinion that engages with the gear ring. The carrier plate is mounted on an axle which is fixedly arranged in a stationary holding device that is fixed to a vertical wall by means of screws. The inventive arrangement is especially useful as door bell or a glockenspiel.

16 Claims, 11 Drawing Sheets

Figure 1:
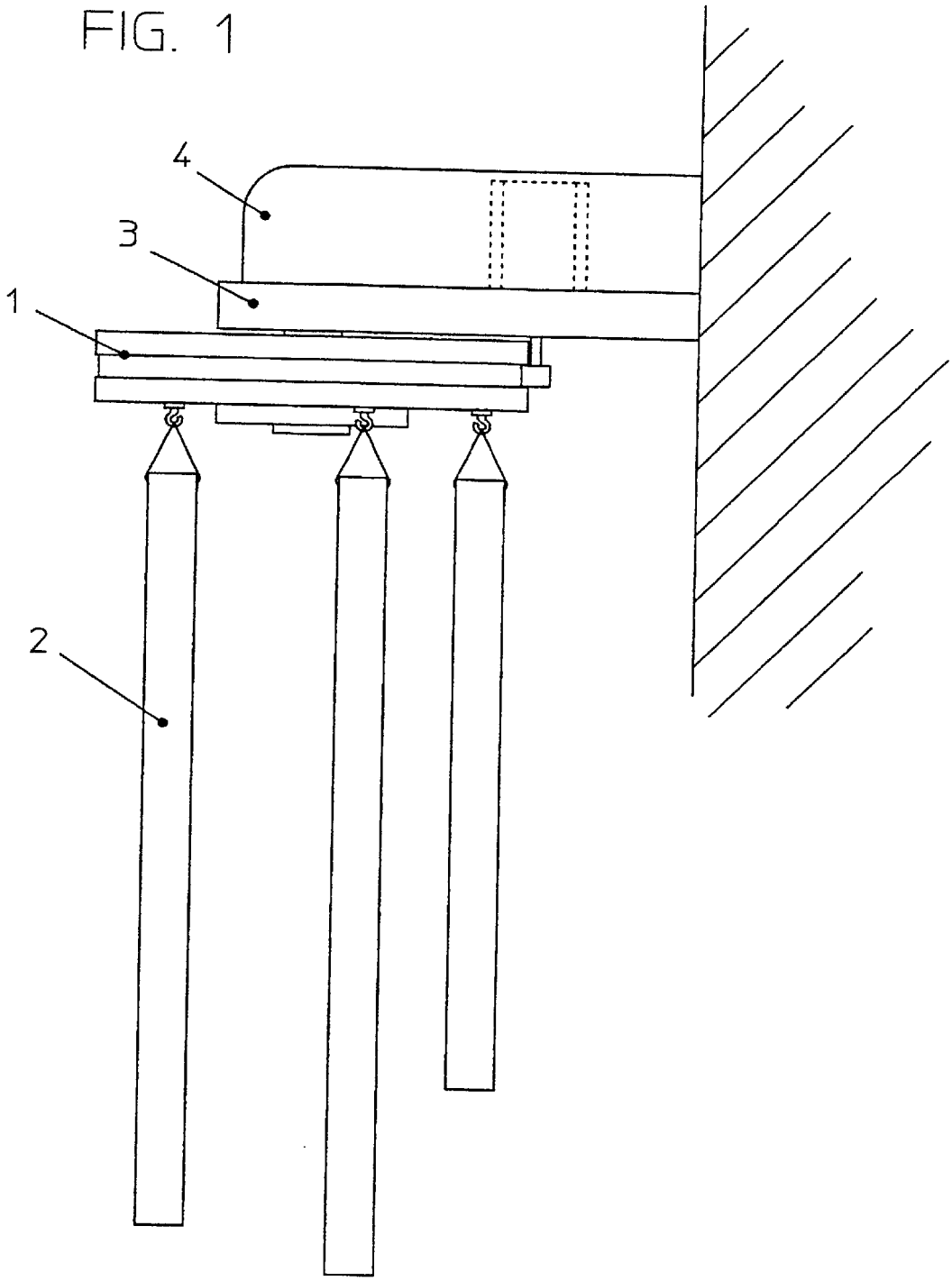

DEVICE FOR PRODUCING SIGNAL TONES BY MEANS OF CHIMES SUSPENDED FROM A SHARED OSCILLATING CARRIER PLATE

CROSS REFERENCE TO RELATED APPLICATIONS

Applicant claims priority under 35 U.S.C. §119 of German Application No. 199 55 343.2, filed on Nov. 17, 1999. Applicant also claims priority under 35 U.S.C. §120 of PCT/DE00/03969, filed on Nov. 14, 2000. The international application under PCT article 21(2) was not published in English.

DESCRIPTION

The invention pertains to a device for producing signal tones of different tone levels by means of chimes that are suspended from a shared carrier plate in an oscillating manner and chime when striking opposing surfaces.

In known devices with chime tubes that are suspended in a freely oscillating manner, signal tones are produced when centrally arranged striking elements of wood or the like impact on the chime tubes. Devices of this type have a decorative purpose or signal windy conditions if they are suspended outdoors. In other known variations, signaling by means of an external mechanical actuation is possible due to an extension of the striking elements.

One disadvantage of these arrangements can be seen in the fact that the circular arrangement of the chime tubes is limited to a minimum diameter because a centrally arranged striking element is required. In addition, the differences between the various chime tube diameters is very limited because the striking distance between the chime tubes and the striking element is also limited in order to achieve a minimum sound intensity. This means that significant differences in tone levels can only be realized by utilizing chimes of different lengths. However, the length of the chimes is also limited due to decorative or spatial circumstances such that the differences in tone levels lie in a very limited range. Consequently, these variations cannot be actuated by an electric pulse (e.g., the actuation of a bell button).

One proposal for eliminating this deficiency was disclosed in DE-PS 197 31 582. In this publication, the striking element is replaced with a centrally arranged motor that drives 3 clapper lines which strike the chimes with their ends beginning at a certain rotational speed. In embodiments for slower rotational speeds and for a larger-size variations, springable clappers are provided as striking elements. The disadvantage of these arrangements can be seen in the fact that the partially elastic impact of the clapper lines results in a brief imbalance that is also transferred onto the punctiform suspension via the motor axle. This means that the entire arrangement, i.e., the suspension, the chimes and the striking assembly, begins to oscillate. This is particularly problematic if the electric pulse (e.g., the actuation of the bell button) is preserved over an extended period of time because the clapper lines are wound around the chime tubes and vice versa and the arrangement ultimately fails. This oscillation of the entire arrangement is also increased by the initial rotational pulse of the motor which is not compensated by the punctiform suspension. In addition, the brief imbalance of the clapper lines which occurs after each impact of the clapper lines on the chime tubes causes problems in the shaft-rotor connection, in particular, with respect to the durability of this connection.

The solution proposed in DE-PS 197 31 582 also does not allow the use of chimes with significantly different diameters for producing substantial differences in tone levels of the chords, namely because the striking distance between the chimes arranged around the centrally situated motor and the clapper lines or springable clappers needs to be constant. In this proposed solution, the differences in tone levels of the chime tubes also can, as described above, only be realized by varying the length of the chime tubes.

The present invention is based on the objective of developing a device for producing signal tones of different tone levels which acoustically signals an electric pulse (e.g., the actuation of a bell button) with one or more chords.

This objective is attained with the characteristics disclosed in claim 1.

The advantages attained with the invention can, in particular, be seen in the fact that no striking element is required. This means that the structural size can be significantly reduced. Since it is possible to actuate the arrangement by means of an electric pulse, it is no longer confined to certain locations but can be arranged at arbitrary locations as long as sufficient space is available. When using chime tubes as the chimes, the chime tube diameters may differ significantly because the chime tubes no longer need to be arranged in a circle. It is merely required to arrange the chime tubes such that they chime when they strike opposing surfaces during the oscillating movement of the carrier plate or after the oscillating movement of the carrier plate is completed. This means that the attainable differences in tone levels lie in an unlimited range. In order to ensure the function of the arrangement, at least two chimes need to be provided, with five chimes being particularly preferred. In addition, the reproducibility of the chime tube impact is, according to the invention, no longer impaired in the form of an oscillation of the entire arrangement caused by the rotational pulse of the starting motor or the striking of the chime tubes with the aid of clapper lines or springable clappers. One advantageous embodiment of the invention is disclosed in claim 2. The additional development according to claim 2 makes it possible to utilize a gearless motor such that the price for commercial applications is significantly reduced. However, the utilization of a gear motor according to claim 7 makes it possible to simplify the mounting of the electric chimes and to minimize the structural size of the drive. Another advantage of the arrangement according to the invention can be achieved if an external mechanical actuation of the arrangement by means of a wind force, the arrangement of the chimes above a door or a manual actuation can still be realized claim 15 provides the additional advantage that the energy supplied to the chimes in the form of motive energy can be precisely defined due to the limitation of the electric pulse and the pause between two electric pulses. This means that the attainable sound intensity of the signaling arrangement can be adjusted, and that an uncontrolled oscillation of the chime tube arrangement is prevented.

Figure 2:
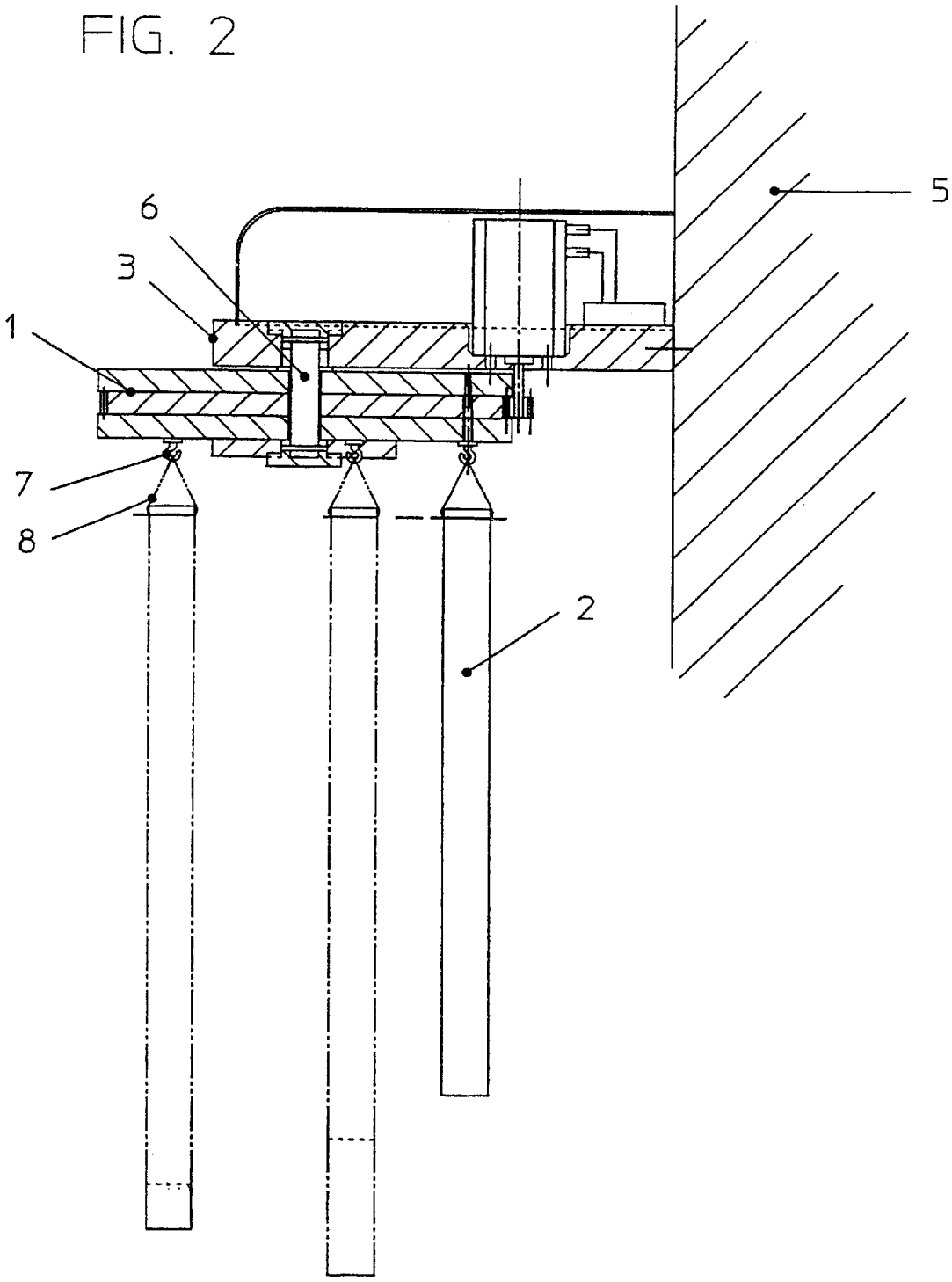
Figure 3:
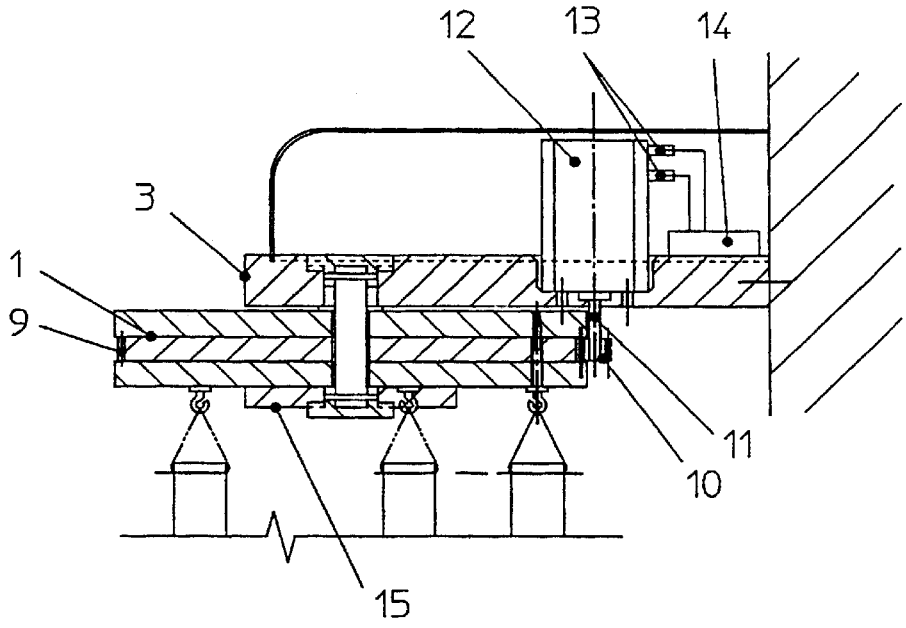
Figure 4:
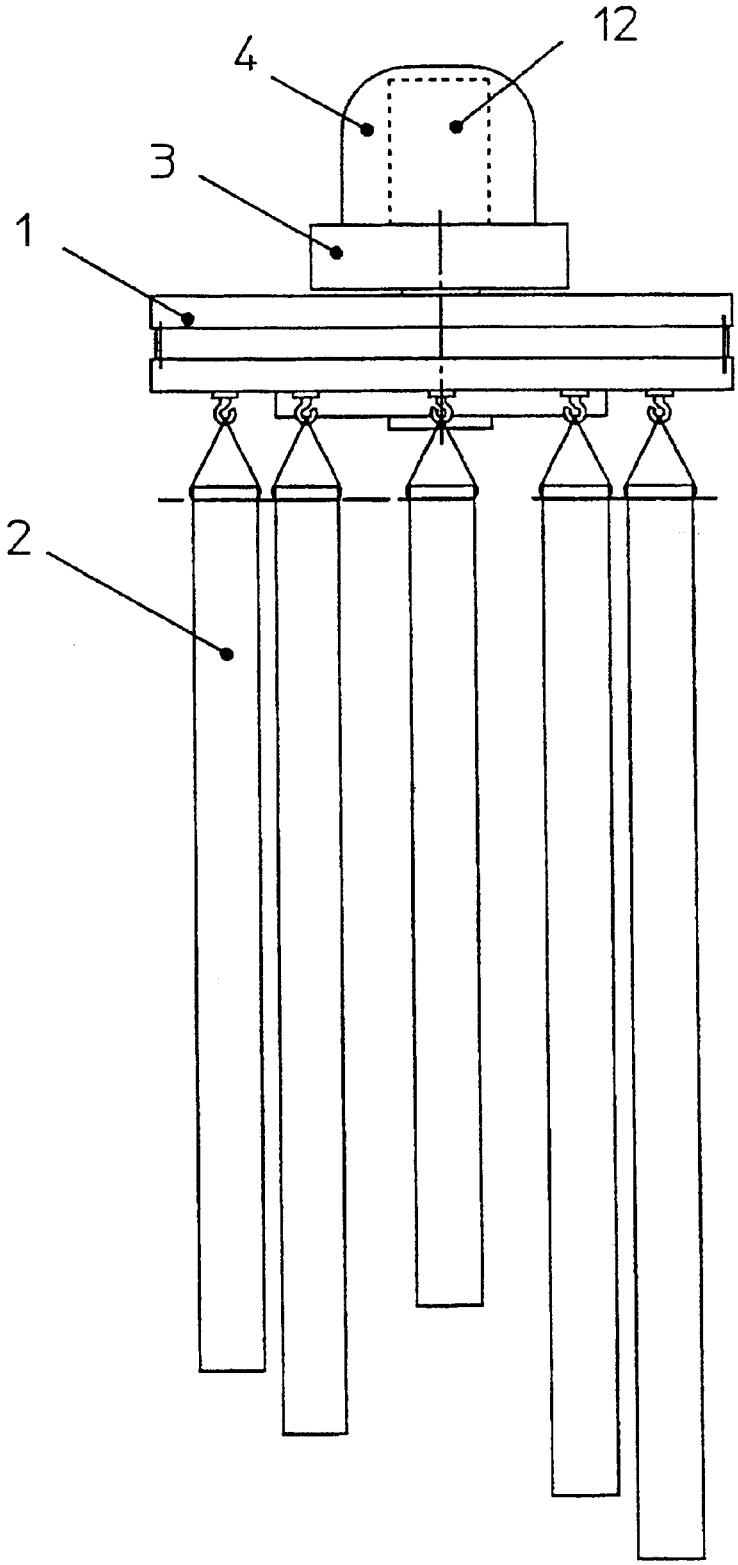
Figure 5:
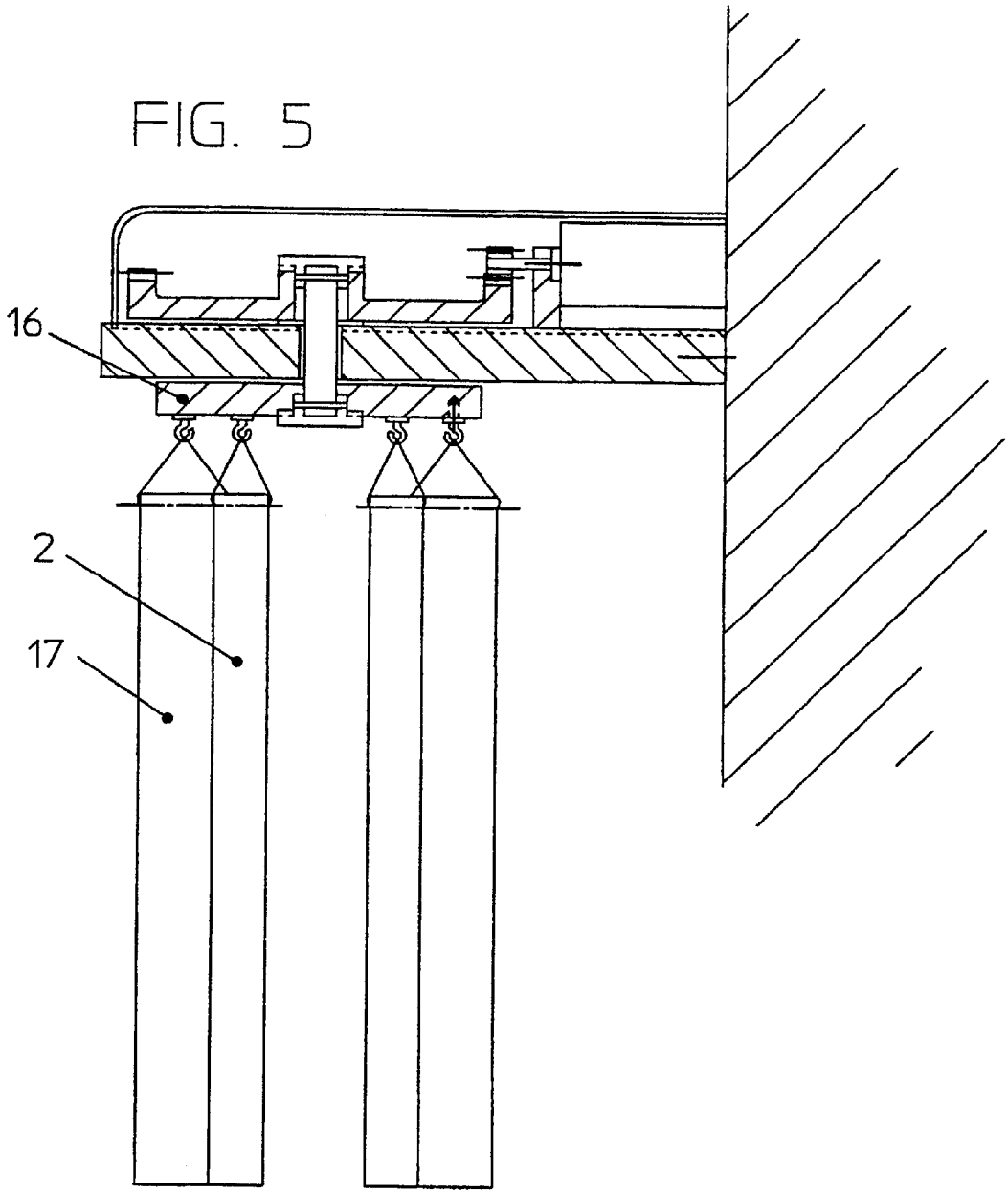
Figure 6:
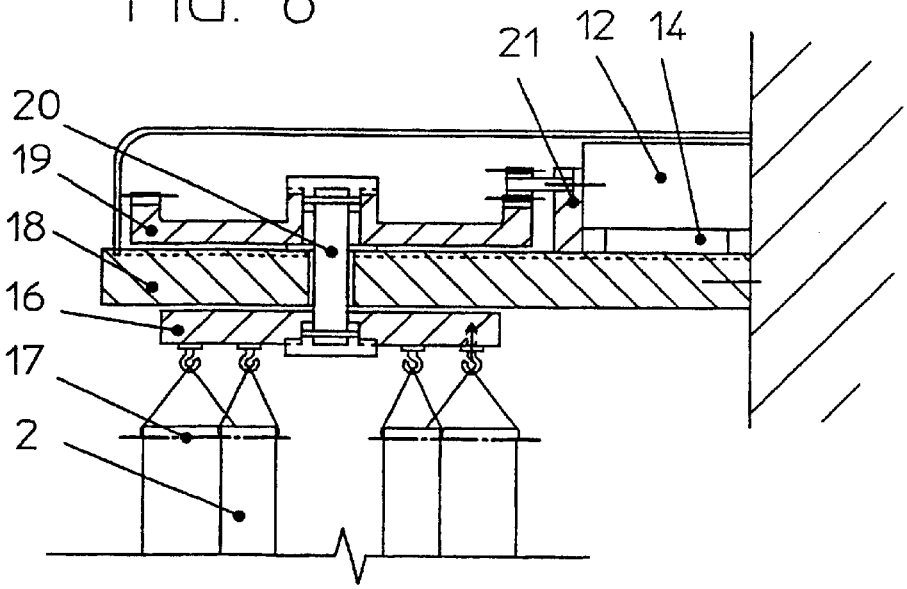
Figure 7:
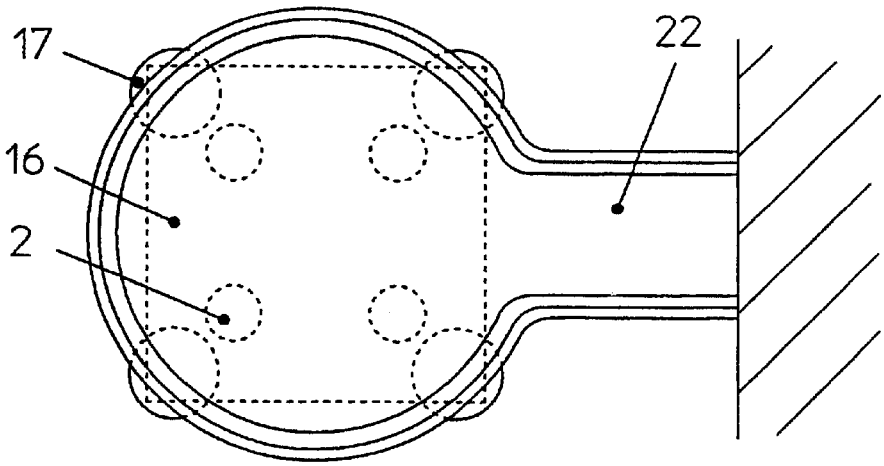
Figure 8:
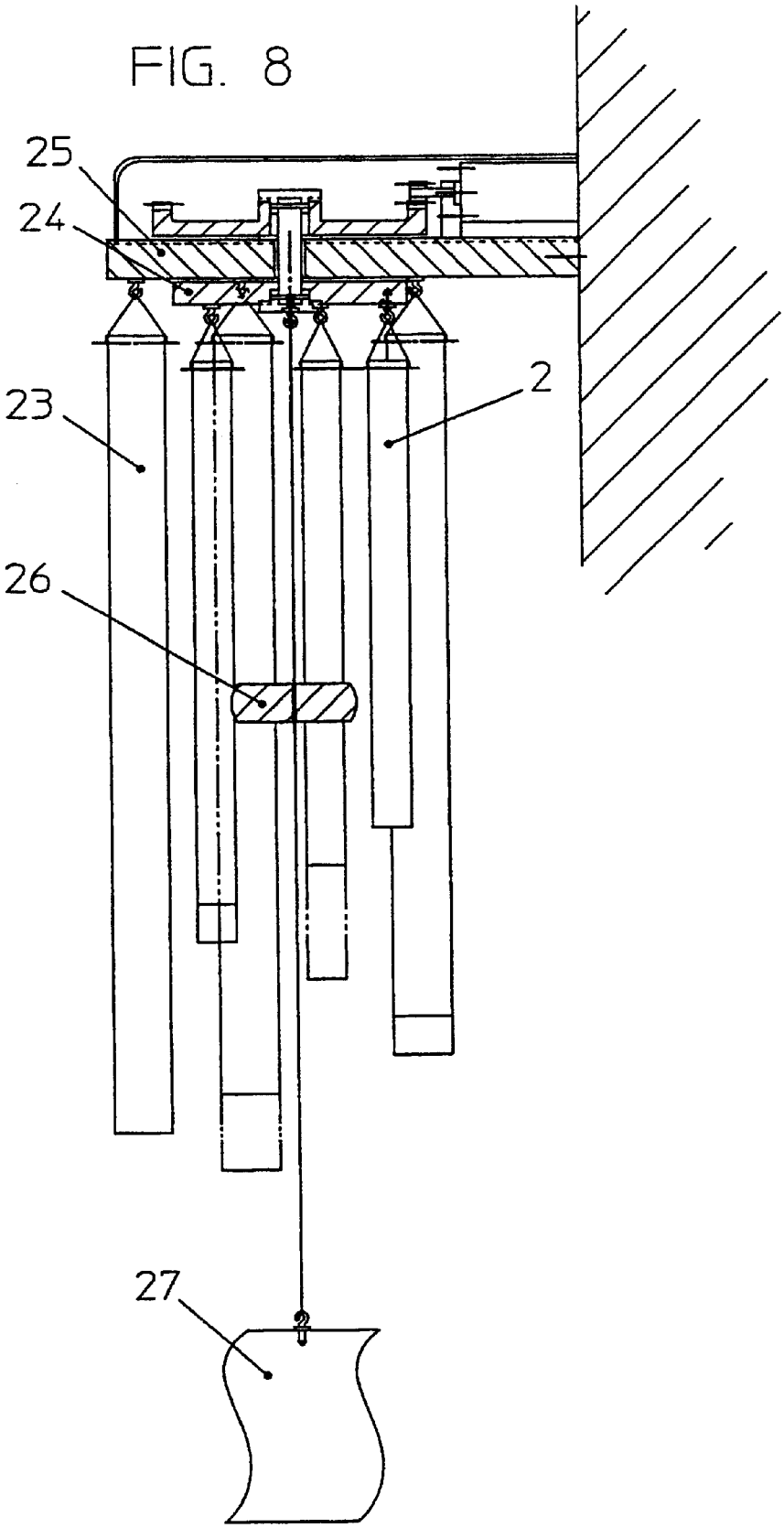
Figure 9:
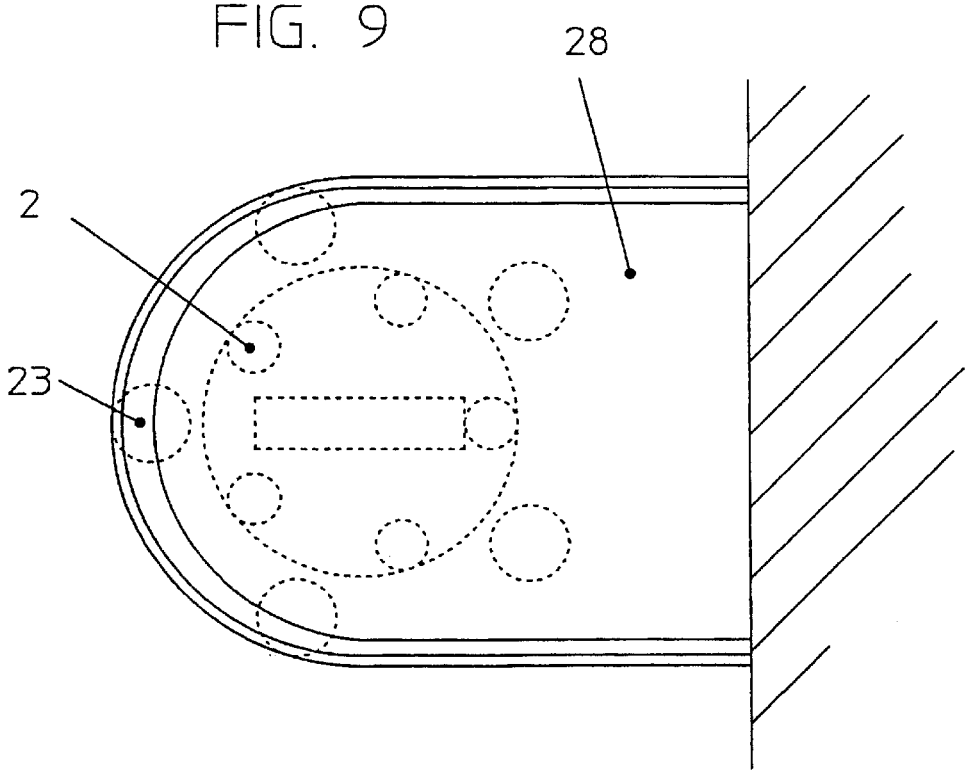

Embodiments of the invention are illustrated in the figures. The figures show:

FIG. 1, a front view of one embodiment of the invention with five chimes of different lengths;

FIG. 2, a complete section through the front view shown in FIG. 1;

FIG. 3, a detailed sectional representation of the drive assembly shown in FIG. 2;

FIG. 4, a side view of the front view shown in FIG. 1 from the left side;

FIG. 5, a completely sectioned front view of another embodiment with eight chime tubes that have the same lengths but different diameters, and with a square carrier plate;

FIG. 6, a completely sectioned detail of the drive assembly shown in FIG. 5;

FIG. 7, a top view of the embodiment shown in FIG. 5;

FIG. 8, a completely sectioned front view of another embodiment with five chimes that can be turned together with the carrier plate, and with five annular chimes of larger diameter which are stationarily arranged at a distance from said rotatable chimes;

FIG. 9, a top view of the front view shown in FIG. 8, and

Figure 10:
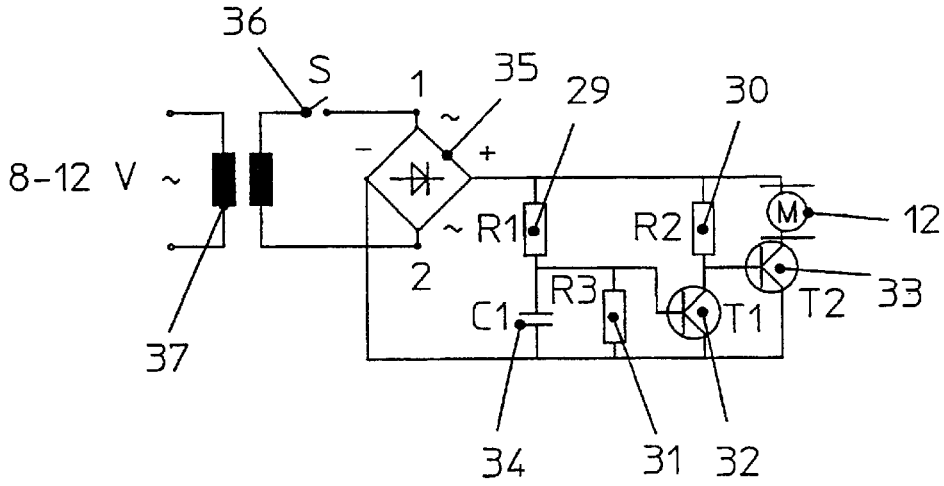

FIG. 10, a schematic representation of the design of the control circuit.

Figure 11:
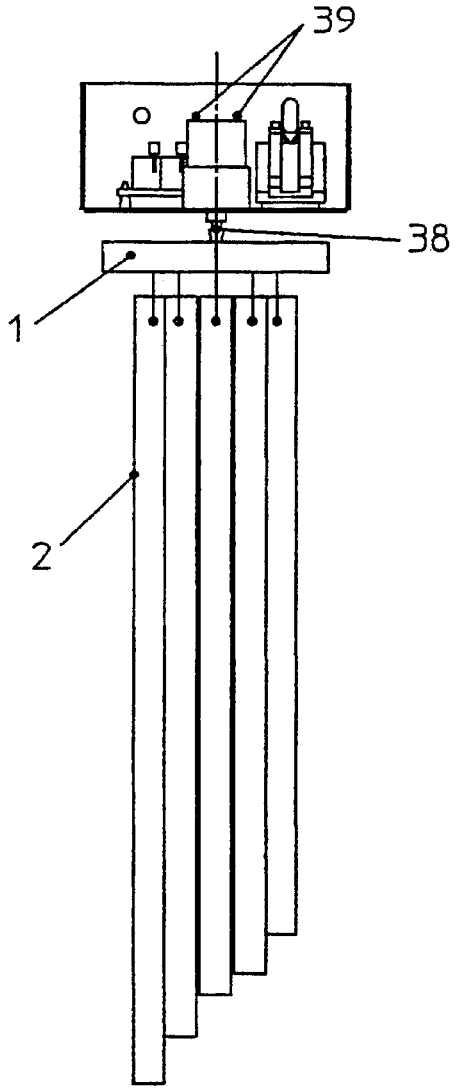
Figure 12:
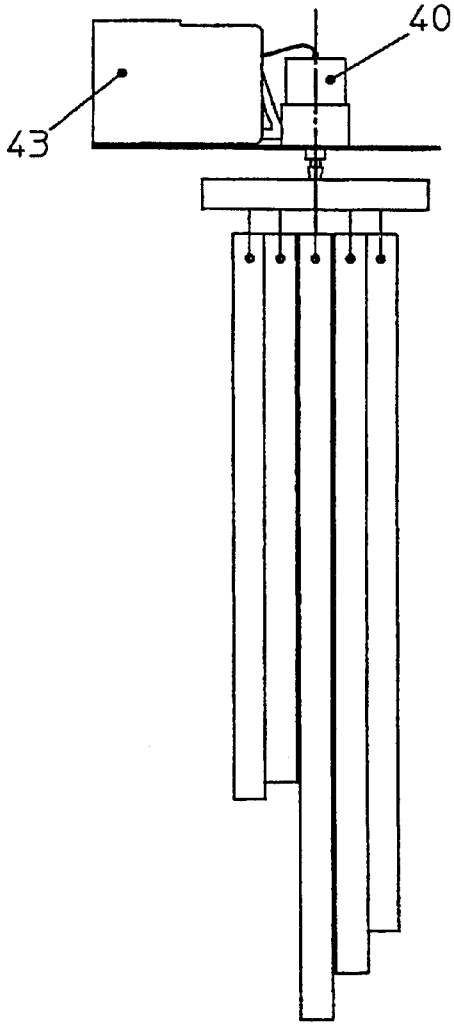
Figure 13:
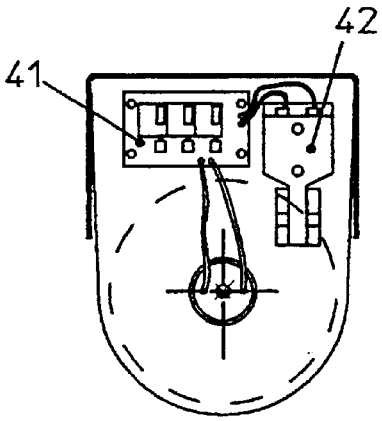
Figure 17:
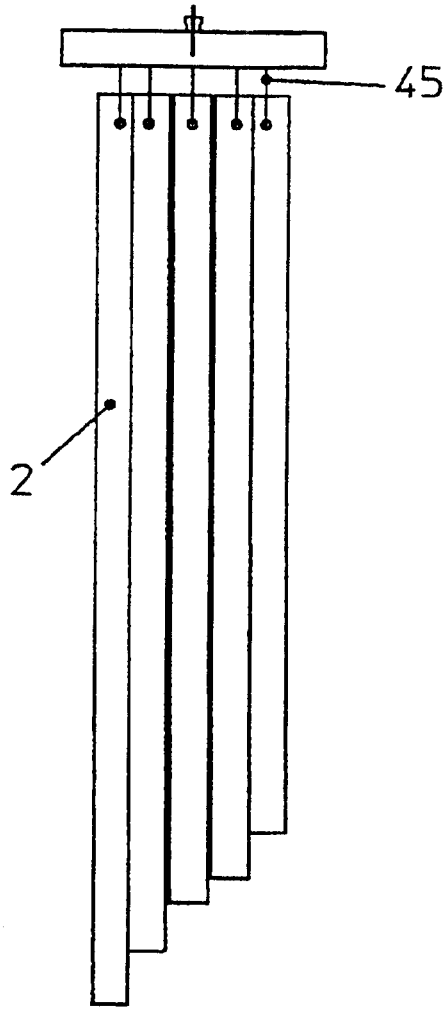
Figure 18:
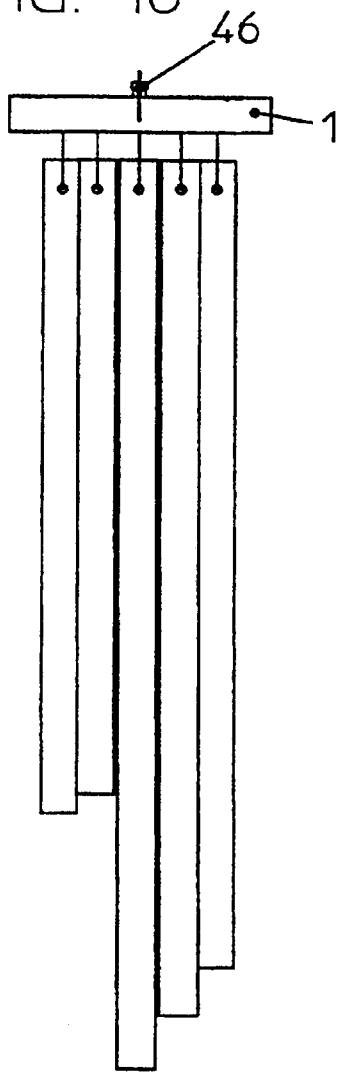
Figure 19:
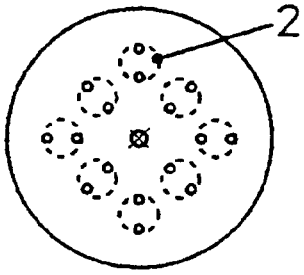

FIG. 11, FIG. 12 and FIG. 13 show the technical design of another embodiment that is illustrated in the form of a standard projection according to DIN 6 T1 and T2. The assembled state of this embodiment is elucidated in FIG. 14, FIG. 15 and FIG. 16. FIG. 17, FIG. 18 and FIG. 19 show the arrangement of the chime tubes.

Embodiments of the present invention are described below with reference to the enclosed figures.

FIG. 1 shows a front view of an embodiment with five chimes. This arrangement consists of a wall holding device 3 that is provided with a cover 4 and contains the drive assembly, a carrier plate 1 and the chime tubes.

FIG. 2 and FIG. 3 show constructive details of this embodiment.

In FIG. 2, the reference symbol 1 identifies the carrier plate, on which the five chimes 2 are suspended by means of mounting screws 7 with the aid of nylon strings 8. The carrier plate 1 is held on an axle 6 that is rigidly arranged in a stationary holding device 3. This holding device 3 is mounted on a vertical wall 5 by means of screws. FIG. 3, in particular, shows that the carrier plate 1 oscillates over a predetermined range by means of an attached gear ring 9 that is engaged with a pinion 10 which is driven by the shaft 11 of a drive motor 12. The carrier plate 1 is held on the annular disk 15. When the carrier plate 1 is abruptly decelerated, the outwardly moved chimes converge again and impact on one another in the center such that a series of harmonic tones is produced. The force of the impact can be adjusted by the oscillating range which, in turn, is defined by the on-time of the drive motor 12 that is controlled by the control circuit 14 with the aid of the contact elements 13.

FIG. 4 shows a side view of this embodiment from the left side. This figure shows the design of the cover 4 that either consists of a sheet metal part or an injection molded plastic part. The drive motor 12 that is arranged in the wall holding device 3 is drawn in a covered manner in this figure. The reference symbol 1 identifies the carrier plate with the chimes 2 suspended thereon.

FIG. 5 shows a completely sectioned front view of another embodiment. In FIG. 5, the reference symbol 16 identifies the square carrier plate, on the corners of which two respective chime tubes are suspended. Four chime tubes 17 that have a greater diameter than the inner chime tubes 2 are suspended on the diagonal of the carrier plate 16. FIG. 6, in particular, shows that the special arrangement according to the invention is realized such that the drive motor 12 is arranged on the mounting 21 in the longitudinal direction and causes an oscillating movement of the chime tubes 2 and 17 by means of a gear ring 19 that is rigidly connected to the carrier plate 16 via a shaft 20. The structural size of the gear ring requires an increase in the structural size of the wall holding device 18 such that the wall holding device protrudes over the carrier plate 16. The reference symbol 14 identifies the control circuit situated underneath the drive motor 12.

FIG. 7 shows a top view of the embodiment shown in FIG. 5. This figure elucidates the suspension of the chimes on the carrier plate 16. The chime tubes 7 with the larger diameters are arranged on the outer diameter, with the smaller chimes 2 being situated farther inward.

The reference symbol 22 identifies the housing part that consists of a sheet metal part or an injection molded plastic part and protects the drive assembly from becoming soiled or damaged.

FIG. 8 shows another embodiment in the form of a completely sectioned front view. In this embodiment, five chime tubes 2 of identical diameters are mounted on the carrier plate 24. Five additional chime tubes 23 of greater diameters are stationarily mounted in an oscillating manner on the wall holding device 25 at a distance from the chime tubes 2, namely in the form of annular arrangement. A striking element 26 of wood is arranged centrally referred to the inner chime tubes 2, with said striking element making it possible to mechanically actuate the arrangement in its idle state due to an extension achieved with the extension element 27. The circular arrangement of the chimes 23 and 2 on different diameters is elucidated further in the top view shown in FIG. 9. The reference symbol 28 identifies the housing part of the device.

FIG. 10 shows the control circuit of the arrangement with an external voltage source that may be selectively realized in the form of a classic bell transformer 37 or a battery (not shown) the circuit consists of a flip-flop arrangement with an RC-element for delay purposes. The rectification is realized with a Graetz circuit 35. Once the control circuit is connected to the bell transformer 37 when the switch S (bell button) 36 is closed, a current flows trough the resistor R2 30 and the base-emitter path of the transistor T2 33 such that the voltage supply of the motor M 12 is ensured via the collector-emitter path of the transistor T2 33. After a duration that is essentially defined by the resistor R1 29 and the capacitor C1 34, the capacitor C1 34 is charged to such a degree that a significant current also flows through the resistor R1 29 and the base-emitter path of the transistor T1 32. This renders the base-emitter path of the transistor T1 32 conductive such that a current is able to flow through the resistor R2 30 and the collector-emitter path [of the transistor] T1 32. This results in a nearly complete drop of the supply voltage on R2 30. This also terminates the current flowing through the base-emitter path of the transistor T2 33 and consequently the voltage supply of the motor M 12 via the collector-emitter path of the transistor T2 33. The resistor R3 31 is switched parallel to the capacitor C1 34 in order to achieve a faster regeneration of the circuit and a smooth discharge of said capacitor. The maximum current of the collector-emitter path of the transistor T2 33 limits the switchable power. All other components are not critical and can be realized with standard components.

FIG. 11, FIG. 12 and FIG. 13 show another embodiment in the form of a standard projection. FIG. 11 and FIG. 12, in particular, show that the special arrangement according to the invention is realized such that the carrier plate 1 is directly held on the axle 38 of a gear motor 40. When an electric pulse is delivered, this gear motor carries out a rotational movement, the duration of which Is defined by the control circuit 41 (FIG. 13), and thusly causes he carrier plate 1 to carry out an oscillating movement together with the chime tubes 2. The gear motor 40 is mounted on the wall plate 43 that serves for mounting the entire arrangement on the wall of a house.

FIG. 13 shows that a battery holder 42 for a 9 V block battery is arranged adjacent to the control circuit 41. This battery ensures the function of the arrangement if a domestic power supply is unavailable.

Figure 14:
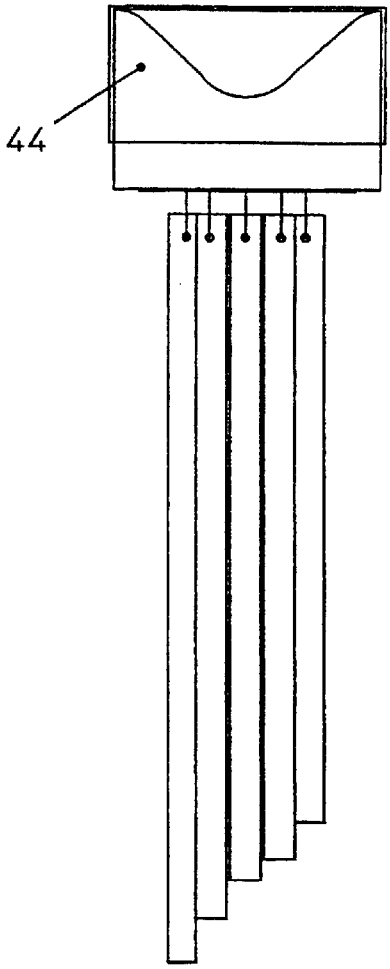
Figure 15:
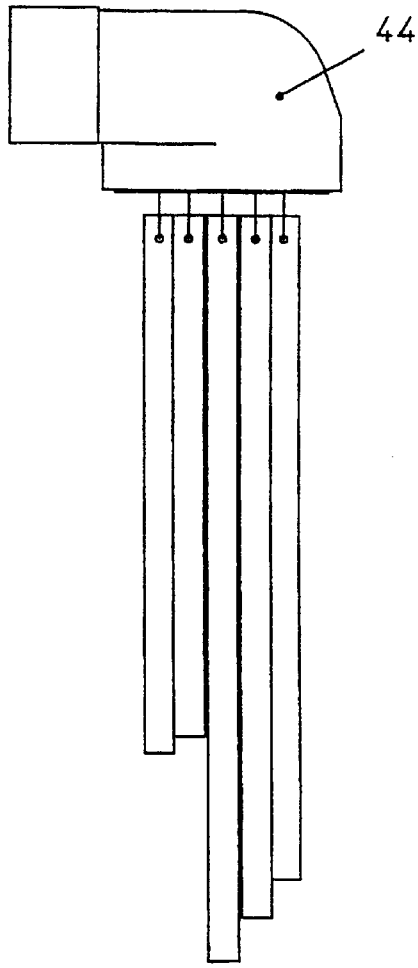
Figure 16:
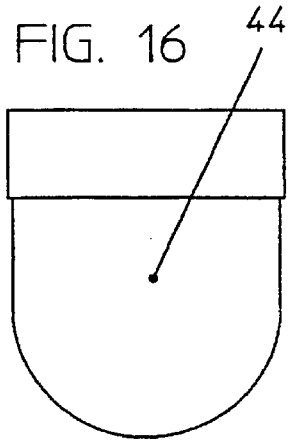

FIG. 14, FIG. 15 and FIG. 16 show the previously described embodiment in the assembled state. The design of the cover 44 is chosen such that it is seated on the wall plate 43 in a precisely fitted fashion (FIG. 12) and thusly reinforces the wall plate in the vertical direction. The cover 44 is realized in the form of an injection molded plastic part in order to maintain the total weight of the arrangement as low as possible. However, this simultaneously serves for achieving a damping effect with respect to the noise level of the gear motor and the rotational pulse, with the user also being protected from the rotating carrier plate 1 (FIG. 11). The The arrangement of the chime tubes 2 is shown in FIG. 17, FIG. 18 and FIG. 19 in the form of a standard projection. The chime tubes 2 are mounted on the carrier plate 1 by means of nylon strings 45. The reference symbol 46 identifies a pressed-in threaded insert which makes it possible to mount the carrier plate 1 on the drive axle 38 (FIG. 11) of the gear motor 40 (FIG. 12). FIG. 19, in particular, shows the arrangement of the chime tubes 2 according to the invention. The chime tubes 2 are arranged on the circumference of a square in such a way that the chime tubes 2 continue to oscillate and simultaneously impact on one another after their initial impact that is caused by the rotational movement generated by the gear motor, with the chime tubes thusly producing a reverberating effect. This arrangement of the chime tubes also makes it possible to realize very slight impacts because the chime tubes already impact on one another when the carrier plate carries out the slightest rotational movement.

What is claimed is:

1. A device for producing signal tones of different tone levels comprising chimes (2) suspended from a shared carrier plate (1) in an oscillating manner, said chimes ring when striking, opposing surfaces, said carrier plate (1) being rotatably held on an axle (6) that is rigidly arranged in a stationary holding device (3), said carrier plate being able to oscillate over a predetermined range together with the chimes (2) by means of a power transmitting element that engages on the carrier plate (1).

2. A device according to claim 1, wherein the carrier plate (1) contains a gear ring (9), into which a power transmitting element realized in the form of a pinion (10) engages.

3. A device according to claim 1, wherein a pinion (10) is mounted on a shaft (11) of a drive motor (12) that can be actuated by means of electric contact elements (13).

4. A device according to claim 1, wherein a gear ring (9) and the carrier plate (1) form one structural unit.

5. A device according to claim 1, wherein a gear ring (9) is arranged on the outer circumference of the carrier plate (1).

6. A device according to claim 1, wherein a gear ring (9) has a smaller diameter than the carrier plate (1) and is attached to said carrier plate.

7. A device according to claim 1, wherein the carrier plate (1) may also be directly held on the axle (38) of the gear motor (40) that can be actuated by means of electric contact elements (39) such that the carrier plate is able to oscillate over a predetermined range together with the chimes (2).

8. A device according to claim 1, wherein a set of chimes (23) which is arranged in an oscillating manner on a part of the stationary holding device is assigned to the chimes (2) that can be turned together with the carrier plate (24), with the former chimes being annularly arranged at a distance from the latter chimes.

9. A device according to claim 1, wherein the oscillating speed of the carrier plate (1) is variable.

10. A device according to claim 1, wherein the oscillating range of the carrier (1) is limited by a limit stop.

11. A device according to claim 1, wherein a limit stop is adjustable.

12. A device according to claim 1, wherein the carrier plate (1) contains an additional striking element (26) that is arranged centrally referred to the chimes in a movable manner and allows the signaling in the form an external mechanical actuation due to an extension achieved by means of an extension element (27).

13. A device according to claim 1, wherein the chimes are realized with identical or different diameters.

14. A device according to claim 1, wherein the power transmitting element can be spatially separated from the carrier plate (16) by utilizing a shaft (20).

15. A device according to claim 1, wherein an electric pulse and a pause between two electric pulses can be limited with respect to their duration by means of a control circuit (14).

16. A device according to claim 1, wherein a control circuit consists of a flip-flop arrangement with an RC-element for delay purposes, comprising the resistors R1 (29), R2 (30) and R3 (31), the transistors T1 (32) and T2 (33), the capacitor C1 (34), the drive motor (12), the Graetz circuit (35), the switch S (36) and the bell transformer (37).

* * * * *